United States Patent [19]

Choyke et al.

[11] 4,123,833

[45] Nov. 7, 1978

[54] METHOD OF PRODUCING DOPED TUNGSTEN FILAMENTS BY ION-IMPLANTATION

[75] Inventors: Wolfgang J. Choyke, Pittsburgh, Pa.; Roland Stickler, Ternitz, Austria

[73] Assignee: Westinghouse Electric Corp., Pittsburgh, Pa.

[21] Appl. No.: 841,774

[22] Filed: Oct. 13, 1977

[51] Int. Cl.[2] ..... H01K 3/02

[52] U.S. Cl. ..... 29/25.18; 29/25.17

[58] Field of Search ..... 29/25.17, 25.18; 316/1; 204/164, 157.1 H

[56] References Cited

U.S. PATENT DOCUMENTS 3,820,868 6/1974 Sell et al. ..... 29/25.17 X

*Primary Examiner*—Richard B. Lazarus

*Attorney, Agent, or Firm*—R. S. Lombard

[57] ABSTRACT

A method of preparing incandescible tungsten filaments which are doped with a predetermined concentration of selected dopant in order to provide filaments with predetermined characteristics. A beam of high velocity ions of the selected dopant are impinged against a target. The target is made up of a thin layer of finely divided tungsten powder. Dopant ions are implanted into the target layer until a predetermined dopant concentration is attained. The ion-implanted tungsten powder is then processed to form tungsten filaments.

3 Claims, 5 Drawing Figures

METHOD OF PRODUCING DOPED TUNGSTEN FILAMENTS BY ION-IMPLANTATION

BACKGROUND OF THE INVENTION

Doped tungsten filaments have been used for many years in incandescent lamps since Aladar Pacz was issued a patent, U.S. Pat. No. 1,410,499 on Mar. 21, 1922 for his discovery that adding very small quantities of an alkali silicate to tungsten a filament could be produced that would not offset nor sag.

Doped tungsten is normally fabricated from doped tungsten powder by a powder metallurgical process. In the process high purity tungsten oxide prepared from tungsten ore is doped with small concentrations of potassium, aluminum, and silicon compounds. The doped tungsten oxide powder is then reduced to tungsten metal powder, which is subsequently compacted and sintered into a high-density ingot. During the sintering process most of the doping substances evaporate and only small traces of certain doping elements remain in the ingot. The ingot is then swaged down to rods, which are then drawn into fine wires. During the process the doping material is distributed in arrays of fine bubbles which are stabilized at high temperatures by vapors of the doping substance. The fine bubbles considerably affect the recrystallization behavior of the heavily deformed tungsten wire, resulting in the desired high-temperature properties. The problem with this conventional tungsten preparation process is that an excess amount of doping elements are introduced and must be removed during the sintering treatment to obtain good wire properties. The conventional process also tends to produce non-uniformities in dopant distribution resulting from non-uniformities in initial additions or non-uniform removal during sintering. This can lead to inhomogeneities in the wire properties which may give rise to localized sagging to hot-spot formation.

In U.S. Pat. No. 3,820,868, dated June 28, 1974 issued to Sell et al is disclosed a method of making a non-sag tungsten filament. The method entails irradiating the tungsten to form therein a very large number of inert gas atoms after a relatively massive sintered ingot has been formed and before the elongated tungsten filamentary member has been heated to a condition of incandescence.

SUMMARY OF THE INVENTION

It has been discovered that desired impurity atoms can be directly introduced into the tungsten powder by an ion-implanation process thereby eliminating the need for the complex chemical doping process. The ion-implantation process as herein disclosed permits a uniform distribution of a controlled amount of doping elements in high-purity tungsten metal powder. Using this process any desired doping element can be implanted. Thus, doping is not limited to doping elements which by the prior art are dictated by the required chemical reaction.

The method of preparing incandescible tungsten filaments utilizing this process comprises first preparing a fine powder of tungsten metal. Then impinging a beam of high-velocity ions of the selected dopant as desired in the filaments against a target comprising a thin layer of the tungsten powder in order to implant the dopant ions in the tungsten powder target layer until a predetermined concentration of the dopant ions is implanted in the tungsten powder target. The ion-implanted powder is then pressed into a self-sustaining compact. The compact is then sintered by heating it in a non-oxidizing atmosphere at a predetermined temperature for a predetermined time to form therefrom a sintered ingot having sufficient density to enable it to be mechanically worked into elongated form without fracture. The sintered ingot is then mechanically worked into greatly elongated filamentary form having a diameter as desired for the filaments. The elongated filamentary wire is then formed into a coiled configuration as desired for incandescible filaments. The filaments are then heated to a condition of incandescence to cause same to recrystallize and form an interlocking non-sag crystal structure.

BRIEF DESCRIPTION OF THE DRAWINGS

For a better understanding of the invention reference may be had to the exemplary embodiments shown in the accompanying drawings in which.

DESCRIPTION OF THE PREFERRED EMBODIMENT

The method of preparing incandescible tungsten filaments which are doped with a predetermined concentration of selected dopant in order to provide the filaments with predetermined operating characteristics.

The method comprises first preparing a fine powder of high-purity tungsten metal. Then impinging a beam of high velocity ions of the selected dopant as desired in the filaments against a target comprising a thin layer of the tungsten powder in order to implant the dopant ions in a tungsten powder target layer until a predetermined concentration of the dopant ions is implanted therein.

Incandescent lamp grade tungsten wire is typically produced from tungsten oxide doped with potassium silicate and aluminum chloride. Within recent years, it has been discovered that the potassium dopant is the source for submicroscopic bubbles which form upon heating lamp filaments and lead to the recrystallized, elongated, interlocking grain structure that gives incandescible filaments their high temperature creep strength. A substantial portion of these bubbles are generally aligned along the axial dimension of the filament and serve to inhibit the recrystallization and control grain growth of the filament due to dislocation and grain boundary pinning by the potassium bubbles. Since small thermodynamically stable bubbles are essentially the medium for the desired strength properties of tungsten filaments, ions of the inert gases helium and argon and in addition, the normal dopants potassium and aluminum are implanted in the highest purity tungsten powder available. The choice of implantation with the inert ions helium and argon was based on the very low solubility of inert gases in metals, which is an intrinsic requirement for the formation of potassium bubbles in regularly doped tungsten.

Figure 1:
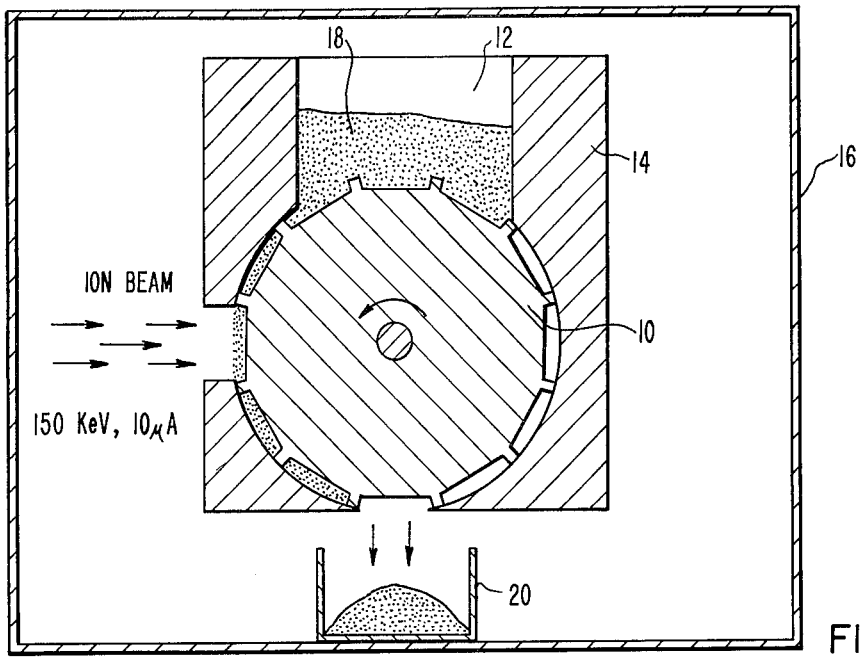
FIG. 1 shows schematically an elevational view of a tungsten powder implantation wheel.

In a preferred embodiment of the invention referring to FIG. 1, tungsten powder to be implanted was passed through a $He^+$ ion beam using the implantation wheel 10 revolving at ½ RPH. A charge of about 20 grams or about 1 $cm^3$ of fine tungsten powder was loaded in the upper section 12 of the wheel housing 14. A chamber 16 containing the implantation wheel 10 and a tungsten powder charge 18 was evacuated to less than $10^{-6}$ Torr. A uno-plasmatron accelerator was used, as is well known in the art, see a book entitled "Ion Implantation" by G. Dearnaley et al, page 333, to produce a mass resolved beam of singly charged helium ions having an ionization potential of 150 keV. The beam was directed onto the revolving wheel 10. After about 75 hours of running time, the total charge of powder had been passed through the ion beam and accumulated in the weighing dish 20 at the bottom of the chamber 16.

The total dosage of $He^+$ in the tungsten powder was determined as follows:

A. The rate of feed (R) for the tungsten powder is first determined by weighing the accumulated powder after rotating the implantation wheel 20 through two complete revolutions. This is equivalent to 4 hour exposure time.

Weight of powder = 1.2494 gm, therefore $$R = \frac{1.2594 \text{ gms}}{4 \text{ hr}} = 0.315 \text{ gm/hr}$$

$$R = 0.315 \text{ gm/hr} \cdot \frac{6.02 \times 10^{23} \text{ atoms/mole}}{183.85 \text{ grams/mole}} = 1.03 \times 10^{21} \, W \text{ atoms/hr.}$$

B. The ion current used was 10 μA. 10 μA = $6.25 \times 10^{13}$ singly charged particles/sec or $$6.25 \times 10^{13} \text{ particles/sec} \cdot 3.6 \times 10^3 \text{ sec/hr.} = 2.25 \times 10^{17} \text{ He}^+ \text{ ions/hr.}$$

Therefore, the ratio $$\frac{\text{He}^+ \text{ ions}}{W \text{ atoms}} = \frac{2.25 \times 10^{17}}{1.03 \times 10^{21}} \cong 2 \times 10^{-4} \text{ or 200 ppm (atomic).}$$

This estimate of the He dosage was probably high due to incomplete packing of the tungsten powder in the space between the ribs on the wheel. A more realistic estimate would be approximately 100 ppm (atomic). The other dopant ions tested were implanted in tungsten powder in the same manner.

On a production bases the beam desirably would use highly stripped atoms and an ionization potential of about 300 keV. The penetration of the dopant ions in the tungsten powder would be considerably improved over the foregoing embodiment. Assuming similar conditions as in the foregoing embodiment and scaling ion current up from 10 $\mu A/cm^2$ to 2 $A/cm^2$ an implanting rate of about $2.5 \times 10^3$/hr with 100 parts per million of the desired dopant atom can be obtained. The power supply required to produce the high voltage, while large, is not outside of easily available components. For further reference the aforemtntioned book entitled "Ion Implantation", written by G. Dearnaley et al. and published by the North-Holland Publishing Company describes in further detail the ion implantation process.

The ion implanted powder is then processed as is well known in the art. The ion implanted powder is first pressed into a self-sustaining compact. The compact is then sintered by heating in a non-oxidizing atmosphere at a predetermined temperature and for a predetermined time to form therefrom a sintered ingot having sufficient density to enable it to be mechanically worked into elongated form witout fracture. For example, the compact is self-resistance sintered at a temperature of about 2900° C. for about 30 minutes in a flowing hydrogen atmosphere producing ingots having a density of about 17 g/cc., or, alternatively, the compact may be furnace sintered at a temperature of about 2100° C. for about 3 hours in a similar atmosphere. The ingot is then mechanically worked into greatly elongated filamentary wire having a diameter as desired for the filaments. The elongated filamentary wire is then formed into a coiled configuration as desired for incandescible filaments. The filaments are then heated to the condition of incandescence to cause same to recrystallize and form an interlocking non-sag crystal structure.

Figure 2A:
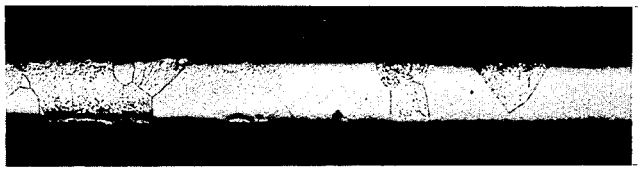
FIG. 2A is a photomicrograph of an undoped 230 μm diameter tungsten wire.
Figure 2B:
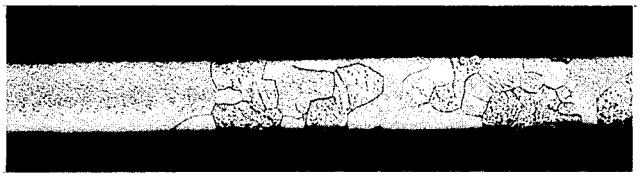
FIG. 2B is a photomicrograph of a 230 μm diameter tungsten wire doped with potassium and aluminum ions.
Figure 2C:
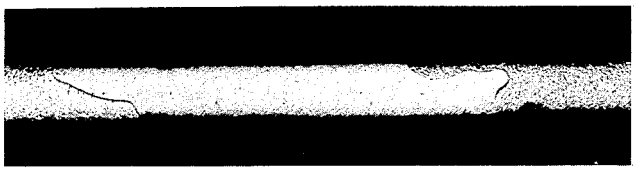
FIG. 2C is a photomicrograph of a 230 μm diameter tungsten wire doped with helium ions.
Figure 2D:
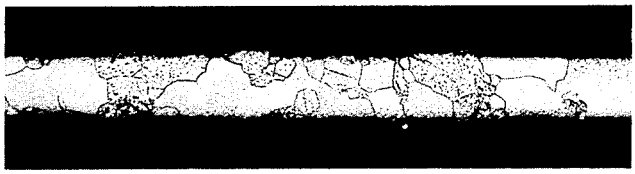
FIG. 2D is a photomicrograph of a 230 μm diameter tungsten wire doped with argon ions.

In FIG. 2A is shown a micrograph of 230 μm diameter undoped tungsten wire. In FIGS. 2B, 2C and 2D are shown photomicrographs of doped tungsten prepared in accordance with the foregoing. The interaction of a grain boundary with bubbles can lead to complete boundary pinning, partial pinning or dragging along of the bubbles. These interactions control grain growth. In this regard, the greatest interaction seems to occur in FIG. 2C in the He ion implanted material because it shows the least amount of grain growth and elongated grains are beginning to appear. This result is in accord with the expectation that the He ion of the dopant ions tested should have the greatest penetration depth in the tungsten powder and, therefore, provide the greatest number of retained bubbles in the wire. Grain growth retardation is also clearly evident in FIG. 2D in the Ar ion implanted material. The most non-uniform effect, if any, is noted in FIG. 2B for the K/Al ion implanted material.

We claim:

1. The method of preparing incandescible tungsten filaments which are doped with a predetermined concentration of selected dopant in order to provide said filaments with predetermined operating characteristics, which method comprises:

(a) preparing a fine powder of tungsten metal;

(b) impinging a beam of high velocity ions of said selected dopant as desired in said filaments against a target comprising a thin layer of said tungsten powder in order to implant said dopant ions in said tungsten powder target layer, and continuing said implantation until a predetermined concentration of said dopant ions is implanted in said tungsten powder target;

(c) pressing said non-implanted powder into a self-sustaining compact;

(d) sintering said compact by heating same in a non-oxidizing atmosphere at a predetermined temperature and for a predetermined time to form therefrom a sintered ingot having sufficient density to enable it to be mechanically worked into elongated form without fracture;

(e) mechanically working said sintered ingot into greatly elongated filamentary wire having a diameter as desired for said filaments;

(f) forming said elongated filamentary wire into a coiled configuration as desired for incandescible filaments; and (g) heating said filaments to a condition of incandescence to cause same to recrystallize and form an interlocking non-sag crystal structure.

2. The method as specified in claim 1, wherein said implanted ions are at least one of helium and argon.

3. The method as specified in claim 1, wherein said implanted ions are at least one of potassium and aluminum.

* * * * *